United States Patent [19]

Marzec et al.

[11] Patent Number: 4,772,414

[45] Date of Patent: Sep. 20, 1988

[54] BLEACHING COMPOSITION

[75] Inventors: Debra S. Marzec, Uniontown, Ohio; Robert C. McQueen, McMurray, Pa.

[73] Assignee: PPG Industries, Inc., Pittsburgh, Pa.

[21] Appl. No.: 889,135

[22] Filed: Jul. 24, 1986

[51] Int. Cl.[4] ..... C11D 3/395; C11D 1/12

[52] U.S. Cl. ..... 252/103; 252/95; 252/186.36; 252/187.26; 252/187.28; 252/187.29; 252/554

[58] Field of Search ..... 252/186.25, 186.34, 252/186.36, 187.24, 187.25, 187.26, 187.27, 187.28, 187.29, 94, 95, 103, 554, 186

[56] References Cited

U.S. PATENT DOCUMENTS

| | | | |
|---|---|---|---|
| 3,172,861 | 3/1965 | Steinhauer et al. | 252/187 |
| 3,758,409 | 9/1973 | Nakagawa et al. | 252/099 |
| 3,929,661 | 12/1975 | Nakagawa et al. | 252/103 |
| 4,005,027 | 1/1977 | Hartman | 252/099 |
| 4,051,055 | 9/1977 | Trink | 252/095 |
| 4,051,056 | 9/1977 | Hartman | 252/99 |
| 4,071,463 | 1/1978 | Steinhauer | 252/103 |
| 4,235,732 | 11/1980 | Beyer | 252/103 |
| 4,428,872 | 1/1984 | Calicott | 252/550 |
| 4,472,291 | 9/1984 | Rosano | 252/186.28 |
| 4,552,680 | 11/1985 | Hartman et al. | 252/102 |
| 4,588,514 | 5/1986 | Jones et al. | 252/187.25 X |

FOREIGN PATENT DOCUMENTS

| | | | |
|---|---|---|---|
| 49-26686 | 7/1974 | Japan . | |
| 60-196723 | 10/1985 | Japan | 252/103 |

OTHER PUBLICATIONS

"Avanel TM S Surfactants. A New Family of Anionics", bulletin published by PPG Industries, Inc., Nov. 1985.

*Primary Examiner*—Richard D. Lovering
*Assistant Examiner*—Virginia B. Caress
*Attorney, Agent, or Firm*—Irwin M. Stein

[57] ABSTRACT

Described is an aqueous bleaching composition comprising (a) hypochlorite-yielding bleaching agent, e.g., sodium hypochlorite, (b) alkaline reagent, e.g., sodium hydroxide, and (c) alkyl poly (ethyleneoxy) sulfonate corresponding to the general formula, $RO(C_2H_4O)_{n-1}CH_2CH_2SO_3M$, wherein R is an alkyl group having from 6 to 30 carbon atoms, n is a number from about 3 to about 20, and M is alkali metal. Optionally, additional miscellaneous materials such as abrasives, builder compounds, etc. may be present to provide a disinfecting cleansing composition.

20 Claims, No Drawings

BLEACHING COMPOSITION

DESCRIPTION OF THE INVENTION

The incorporation of a hypochlorite bleaching agent, e.g., sodium hypochlorite, into liquid cleaning compositions is highly desirable because the hypochlorite is effective in promoting soil and stain removal and is also an effective disinfectant. However, because of the powerful oxidizing power of hypochlorite bleach, its incorporation into liquid cleaning compositions generally results in poor shelf life for the cleaning composition because of the chemical interaction between the hypochlorite bleach and organic surfactants that are used in such products. Such cleaning compositions have various degrees of chemical instability because surfactants are reported to promote decomposition of the hypochlorite and/or the hypochlorite may attack, i.e., oxidize, the surfactant, thereby resulting in the degradation and loss of effectiveness of such materials in the cleaning composition.

It has now been discovered that incorporation of alkyl poly (ethyleneoxy) sulfonates into an alkaline aqueous hypochlorite bleaching compositions provides a composition which is relatively stable during storage at room temperatures.

DETAILED DESCRIPTION OF THE INVENTION

In one embodiment, the present invention relates to an aqueous bleaching composition comprising a hypochlorite-yielding bleaching agent, an alkaline reagent capable of maintaining the bleaching composition at an alkaline pH, and an alkyl poly (ethyleneoxy) sulfonate surface active agent.

As the hypochlorite-yielding bleaching agent, there may be used any of the well known compounds which produce the hypochlorite ion ($OCl^-$) in alkaline aqueous solution. Examples of such compounds include alkali metal and alkaline earth metal hypochlorites, hypochlorite addition products, chloramines, chlorimines, chloramides and chlorimides. Examples of the aforesaid compounds include: sodium hypochlorite, potassium hypochlorite, calcium hypochlorite, magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, chloramine-T, dichloramine-T, chloramine-B and dichloramine-B. Preferably, the hypochlorite-yielding bleaching agent is sodium hypochlorite, potassium hypochlorite or calcium hypochlorite. Sodium hypochlorite is economically preferred.

Many of the above-described hypochlorite-yielding bleaching agents are available in solid or concentrated form and dissolve in water readily. Some of the bleaching agents, such as sodium hypochlorite, are commercially available as aqueous solutions.

The bleaching reagent is present in the compositions of the present invention at levels which provide from about 0.1 to about 10 percent available chlorine, more typically, between about 0.2 and about 5.5 percent available chlorine.

Bleaching compositions of the present invention also contain an inorganic alkaline buffering reagent in amounts sufficient to maintain the bleaching composition alkaline. Preferably, the alkaline reagent is chosen and used in amounts which will maintain the pH of the composition at at least about 10 and preferably from about 10.5 to 13. The amount of alkaline reagent used may commonly vary between about 0.05 and about 10, e.g., between about 0.05 and about 5, weight percent, based on the weight of the bleaching composition.

Maintaining the bleaching composition at a pH of at least 10.0 minimizes chemical decomposition of the hypochlorite-yielding bleaching agent in aqueous media, thereby promoting chemical stability of the composition. Further, the alkaline pH serves to enhance soil and stain removal by the surfactant during utilization of the present composition.

Any bleach-stable material or mixture of materials which are water soluble and which are capable of maintaining the bleaching composition alkaline, e.g., at a pH of at least 10, may be utilized as the alkaline reagent in the described bleaching composition. Such materials need be water-soluble only to the extent of their utilization in the composition at room temperature. Typically, such materials include inorganic salts such as the alkali metal, e.g., sodium and potassium, carbonates, sesquicarbonates, hydroxides, silicates, phosphates, tetraborates, and mixtures of such alkali compounds. Specific examples of materials which may be used (alone or in combination) as the alkaline reagent in the bleaching composition include: sodium hydroxide, potassium hydroxide, potassium carbonate, sodium bicarbonate, sodium sesquicarbonate, sodium silicate, tetrapotassium pyrophosphate, trisodium phosphate, anhydrous sodium tetraborate, sodium tetraborate tetrahydrate, sodium tetraborate decahydrate and mixtures of such materials.

The surface active agent that is used in the present composition is an alkyl poly (ethyleneoxy) sulfonate that may be represented by the general formula:

$$RO(C_2H_4O)_{n-1}CH_2CH_2SO_3M$$

wherein R is a branched or straight chain $C_6$–$C_{30}$ alkyl, n is a number between about 2 and about 40, and M is an alkali metal, e.g., sodium, lithium and potassium. More particularly, R may contain from about 8 to about 18 carbon atoms, e.g. from about 11 or 12 to about 15 carbon atoms. R may be a mixture of alkyl groups which may be represented by the general formula, $$(C_mH_{2m+1})- \qquad \text{II}$$

wherein m represents the average carbon chain length in the alkyl group. The average carbon chain length may vary and will depend frequently on the manufacturer of the precursor alkanol product from which the alkyl group, R, is derived.

In one embodiment of the present invention, R is an essentially linear alkyl group of from about 6 to about 30 carbon atoms, more commonly from about 8 to about 18 carbon atoms. In a further embodiment, R is a branched alkyl, e.g., primary or secondary alkyl group of from about 6 to about 30 carbon atoms, more typically from about 8 to about 18 carbon atoms, e.g., 2-ethylhexyl, isodecyl and tridecyl. In a preferred embodiment, R contains from 11 or 12 to 15 carbon atoms. In a more preferred embodiment, R is a branched alkyl such as 2-ethylhexyl. Bleaching compositions containing 2-ethylhexyl poly (ethyleneoxy) sodium sulfonates have exhibited good storage stability at elevated temperatures, e.g., 50° C.

The letter "n" in formula I, i.e., the number of ethylene oxide units present per mole of the aforedescribed alkyl poly (ethyleneoxy) sulfonate molecule, designates the average number of moles of ethylene oxide present per mole of sulfonate and hence may be less than a whole number. Thus, even though "n" is denoted as a number between 2 and 40, each sulfonate compound may contain a distribution of units with the "n" value representing the average number of moles of ethylene oxide per mole of sulfonate. Preferably, "n" is a number of between about 3 and about 20, e.g., 4 to 16. More preferably, "n" is a number between about 6 and 8 or 9. M is typically the alkali metal sodium or potassium.

The sulfonate surface active agent is water soluble or dispersible to the extent of its use in the aqueous bleaching composition and is typically present in amounts of between about 0.03 and about 10 weight percent, more typically between about 0.1 and about 5 weight percent, based on the weight of the bleaching composition.

In addition to the aforedescribed components of the bleaching composition, other optional materials commonly found in liquid scouring cleansers and hard surface cleaners may also be included. For example, in order to increase foaming or detergency of the composition, alkyl sulfate surfactants of the formula, $R'O-SO_3M$, may be added to the bleaching composition. In the aforesaid formula, R' may be a primary alkyl group containing from about 8 to about 22, preferably from about 10 to about 18 carbon atoms, and M is an alkali metal, e.g., sodium or potassium. Specific examples of such alkyl sulfates include: sodium lauryl sulfate, sodium myristyl sulfate, potassium hexadecyl sulfate, sodium octadecyl sulfate, coconut alkyl sulfate and tallow alkyl sulfate. The amount of alkyl sulfate that may be added to the composition to provide higher sudsing or foaming may vary but generally will be used in a weight ratio of the above described sulfonate surface active agent to alkyl sulfate of between about 10:1 and about 5:1. Although alkyl sulfates are not considered stable to hypochlorite, a small amount of such sulfate to increase the foaming potential of the composition may be used. When included in the composition, the alkyl sulfate replaces a portion of the alkyl poly (ethyleneoxy) sulfonate surface active agent so that the levels of surfactant in the bleaching composition are as described hereinabove. In place of, or in addition to, the alkyl sulfate surfactant, a small amount of linear alkyl benzene sulfonate, alkyl paraffin sulfonates, or alpha olefin sulfonates (or their alkali metal, e.g., sodium, salts) may be added to the composition as a foaming agent. Examples of such sulfonates include sodium dodecyl benzene sulfonate and sodium tetradecyl alpha olefin sulfonate.

Materials which act as a detergent builder, i.e., a material which reduces the free calcium and/or magnesium ion concentration in the bleaching composition may also be included therein. Some of the aforedescribed alkaline reagents may additionally serve as builder materials.

A particulate insoluble abrasive and a suspending agent which serves to keep the abrasive suspended in the composition may also be included in the bleaching composition. The particulate abrasive material may comprise between about 0.5 and about 10 weight percent, typically between about 1 and about 5 weight percent, of the composition. Such insoluble materials commonly have particle size diameters ranging from about 1 to about 250 microns and specific gravities of from about 0.2 to about 5.0. Abrasives which may be utilized include, but are not limited to, quartz, pumice, pumicite, titanium dioxide, silica sand, calcium carbonate, zirconium silicate, diatomaceous earth, whiting, feldspar, perlite and expanded perlite.

Suspending agents, fillers, thickeners and stabilizers that are used in combination with the abrasive material are commonly inorganic colloid forming clays selected from the group consisting of smectites, attapulgites and mixtures thereof. The colloid forming clays should be compatible and stable in the presence of the hypochlorite bleaching agent. The clays combine with the free water of the liquid composition to form fluid compositions which are false-bodied in nature. The clay suspending agent may generally be present in the composition to the extent of from about 0.5 percent to 10 percent by weight based on the total composition.

In addition to the above-mentioned adjuvants, the bleaching composition may optionally also contain other materials to enhance its performance, stability and aesthetic appeal. Such materials include optional non-buffering builder compounds, coloring agents, optical brighteners and perfumes. The aforedescribed materials also should be stable against degradation by the hypochlorite bleaching agent, and are used in amounts conventional in the art.

A major portion of the bleaching composition is water, which serves as the medium to dissolve or disperse the components of the bleaching composition, e.g., the hypochlorite bleach, the surfactant, the alkaline reagent and other optional materials (as described above) that may be incorporated into the composition. Typically between about 70 and about 95 percent by weight, more typically between about 80 and about 95 percent by weight of the aqueous bleach composition is water. Bleaching compositions of the type described herein are often characterized by their "solids" content. For liquid, e.g., readily flowable, compositions of low viscosity the solids content will typically be less than 10 percent; whereas for more viscous, i.e., semi-liquid (fluid) compositions and pastes, the solids content will typically be on the order of 25 to 30 percent, or higher.

The bleaching composition of the present invention may be prepared by admixing together the components comprising the composition in desired concentrations by conventional mixing equipment. Sufficient water is added to the mixture or provided by an aqueous solution of one of the ingredients to provide a composition having the requisite concentrations, i.e., the balance of the composition (up to 100 percent)—after subtracting all of the ingredient percentages (including optional ingredients) is water. Some shear agitation is generally necessary to insure proper preparation of the compositions when they contain an abrasive and suspending agent.

The bleaching composition described herein may be used in a wide variety of cleaning and scouring operations where bleaching and/or disinfecting performance is required. For example, the non-abrasive compositions herein find use in cleaning and disinfecting of floors, food processing equipment, etc. The abrasive compositions find use in the scouring of sinks, bathtubs, and various other hard surfaces where soil accumulates and is difficult to remove.

The present invention is more particularly described in the following examples which are illustrative only since numerous modifications and variations therein will be apparent to those skilled in the art.

EXAMPLE 1

Aqueous bleaching compositions were prepared by mixing 96 parts of a 5% sodium hypochlorite aqueous solution, 2 parts of sodium hydroxide and 2 parts of the test surfactant. The compositions were stored at room temperature (about 25° C.). Periodically, samples of the compositions were removed and tested for available chlorine. A composition containing no added surfactant was used as the control. Table I reports results of the test.

TABLE I

| SAMPLE | % Available Chlorine Week No. 2 | 3 | 4 | 5 | 6 | 7 | 8 | 9 | 11 | 13 | 15 | 18 | 21 | 26 |
|---|---|---|---|---|---|---|---|---|---|---|---|---|---|---|
| Control | 5.1 | 5.1 | 5.1 | 5.1 | 4.9 | 4.9 | 4.8 | 4.8 | 4.7 | 4.6 | 4.5 | 4.3 | 4.0 | 3.5 |
| A* | 5.1 | 5.1 | 5.0 | 5.0 | 4.8 | 4.8 | 4.7 | 4.7 | 4.5 | 4.5 | 4.4 | 4.3 | 4.0 | 3.6 |
| B* | 5.1 | 5.1 | 5.0 | 5.0 | 4.8 | 4.8 | 4.7 | 4.7 | 4.5 | 4.4 | 4.4 | 4.2 | 3.9 | 3.4 |
| C* | 5.1 | 5.1 | 5.0 | 4.9 | 4.8 | 4.8 | 4.7 | 4.7 | 4.5 | 4.4 | 4.3 | 4.1 | 4.0 | 3.3 |
| D* | 5.1 | 5.1 | 5.1 | 5.0 | 4.8 | 4.8 | 4.8 | 4.6 | 4.6 | 4.4 | 4.4 | 4.2 | 4.0 | 3.5 |
| E* | 5.1 | 5.0 | 5.0 | 4.9 | 4.7 | 4.7 | 4.6 | 4.5 | 4.2 | 4.0 | 3.9 | 3.7 | 3.4 | 2.8 |

*A - Alkyl poly (ethyleneoxy) sodium sulfonate having from 12 to 15 carbon atoms and an average of 7 ethoxy groups.
B - Alkyl poly (ethyleneoxy) sodium sulfonate having from 12 to 15 carbon atoms and an average of 9 ethoxy groups.
C - Alkyl poly (ethyleneoxy) sodium sulfonate having from 12 to 15 carbon atoms and an average of 15 ethoxy groups.
D - Sodium dodecyl diphenyl oxide disulfonate
E - Monofax 1214; organic phosphate ester (free acid form)

The data of Table I show that the percent available chlorine of the compositions of the present invention is essentially the same as that of the control which contains no surfactant over a period of 5–6 months.

EXAMPLE 2

Aqueous bleaching compositions were prepared by mixing 96 parts of water, 2 parts of sodium hypochlorite, 1 part of sodium hydroxide and 1 part of the test surfactant. The compositions were stored at 50° C. Samples of the compositions were removed weekly and tested for available chlorine. Compositions containing no added surfactant were used as the control. Results are tabulated in Table II.

TABLE II

| SAMPLE | % Available Chlorine Days 0 | 7 | 14 | 21 | 28 | 35 |
|---|---|---|---|---|---|---|
| F* | 1.6 | 1.4 | 1.1 | 1.0 | 0.8 | 0.7 |
| G* | 2.0 | 1.6 | 1.3 | 1.0 | 0.9 | — |
| H* | 2.0 | 1.7 | 1.4 | 1.3 | 1.1 | — |
| Control-1 | 2.1 | 1.8 | 1.5 | 1.3 | 1.2 | — |
| Control-2 | 1.6 | 1.5 | 1.3 | 1.2 | 1.1 | 1.0 |

*F - Alkyl poly (ethyleneoxy) sodium sulfonate having from 6 to 10 carbon atoms and an average of 3 ethoxy groups
G - Sodium decyl diphenyl oxide disulfonate
H - Sodium 2-ethylhexyl poly (ethyleneoxy) sulfonate having an average of 3 ethoxy groups While the present invention has been exemplified with respect to certain embodiments thereof, it is to be understood that the invention is not intended to be limited to such details except as and insofar as they appear in the appended claims.

What is claimed is:

1. In an aqueous bleaching composition comprising hypochlorite-yielding bleaching agent, sufficient alkaline reagent to maintain the composition at an alkaline pH, and surface active agent, wherein the hypochlorite bleaching agent is present at levels which provide from about 0.1 to about 10 percent available chlorine, the improvement wherein the surface active agent corresponds to the general formula, $$RO(C_2H_4O)_{n-1}CH_2CH_2SO_3M,$$

wherein R is an alkyl group having from 6 to 30 carbon atoms, n is a number from about 3 to about 20, and M is alkali metal.

2. The aqueous composition of claim 1, wherein the hypochlorite-yielding bleaching agent is sodium hypochlorite, calcium hypochlorite or potassium hypochlorite, the alkaline reagent is selected from the group consisting of the hydroxides, carbonates, phosphates and silicates of sodium or potassium, R is an alkyl group having from 8 to 18 carbon atoms, M is sodium or potassium and n is a number from about 4 to about 16.

3. The aqueous composition of claim 2 wherein the surfactant is selected from the group consisting of 2-ethylhexyl poly(ethyleneoxy) sodium sulfonate and isodecyl poly(ethyleneoxy) sodium sulfonate, each having an average of from about 4 to about 16 ethoxy group, the bleaching agent is sodium hypochlorite and the alkaline reagent is selected from the group consisting of sodium hydroxide and potassium hydroxide.

4. The aqueous composition of claim 2 wherein the surfactant corresponds to the general formula, $$RO(C_2H_4O)_{n-1}CH_2CH_2SO_3M,$$

wherein R is an essentially linear alkyl group having from about 8 to about 18 carbon atoms, and M is sodium.

5. The aqueous composition of claim 2 wherein the bleaching agent is sodium hypochlorite, the alkaline reagent is selected from the group consisting of sodium hydroxide and potassium hydroxide, R is an alkyl group having from about 11 to 15 carbon atoms and n is a number of from about 6 to 9.

6. The aqueous composition of claim 5 wherein R is an alkyl group having from about 12 to 15 carbon atoms and n is a number of from about 6 to 8.

7. The aqueous composition of claim 1 wherein the surfactant is 2-ethylhexyl poly(ethyleneoxy) sodium sulfonate or isodecyl poly(ethyleneoxy) sodium sulfonate, each having an average of three moles of ethylene oxide per mole of sulfonate.

8. The aqueous composition of claim 7 wherein the hypochlorite-yielding bleaching agent is sodium hypochlorite or calcium hypochlorite, and the alkaline reagent is sodium hydroxide.

9. The aqueous composition of claim 1 wherein the pH of the composition is from about 10.5 to about 13.

10. The aqueous composition of claim 1 wherein the composition contains from about 0.03 to about 10 weight percent of surface active agent.

11. The aqueous composition of claim 1 wherein the composition also contains adjuvant ingredients selected from the group consisting of particulate abrasive material, detergents, suspending agents, coloring agents and perfumes.

12. An aqueous liquid bleaching composition comprising:

(a) hypochlorite-yielding bleaching agent in amounts sufficient to provide from about 0.1 to about 10 weight percent available chlorine;

(b) alkaline reagent in amount sufficient to provide a composition having a pH of at least about 10;

(c) from about 0.03 to about 10 weight percent of anionic surface active agent, said surface active agent being the principal surface active agent in the bleaching composition and corresponding to the general formula, $$RO(C_2H_4O)_{n-1}CH_2CH_2SO_3M$$

wherein R is an alkyl group having from 6 to 30 carbon atoms, n is a number of from about 3 to about 20, and M is an alkali metal; and (d) the balance being water.

13. The bleaching composition of claim 12 wherein the alkaline reagent is present in amounts of between about 0.05 and about 5 weight percent, thereby to maintain the pH of the composition between at least 10 and about 13.

14. A bleaching composition according to claim 12 wherein the hypochlorite-yielding bleaching agent is sodium hypochlorite, calcium hypochlorite or potassium hypochlorite, the alkaline reagent is selected from the group consisting of the hydroxides, carbonates, phosphates and silicates of sodium or potassium, R is an alkyl group having from 8 to 18 carbon atoms, M is sodium or potassium and n is a number of from about 4 to about 16.

15. The bleaching composition of claim 14 wherein the hypochlorite-yielding bleaching agent is present in amounts sufficient to provide from about 0.2 to about 5.5 weight percent available chlorine, the alkaline reagent is present in amounts of between about 0.05 and 5 weight percent, and the surface active agent is present in amounts of between about 0.1 and about 5 percent.

16. The bleaching composition of claim 14 wherein the bleaching agent is sodium hypochlorite, the alkaline reagent is sodium hydroxide or potassium hydroxide, R is an alkyl group having from about 11 to 15 carbon atoms and n is a number of from about 6 to 9.

17. The bleaching composition of claim 16 wherein R is an alkyl group having from about 12 to 15 carbon atoms and n is a number of from about 6 to 8.

18. The bleaching composition of claim 14 wherein R is 2-ethylhexyl or isodecyl.

19. The bleaching composition of claim 18 wherein the surfactant is 2-ethylhexyl poly (ethyleneoxy) sodium sulfonate having an average of three ethoxy groups.

20. The bleaching composition of claim 18 wherein the bleaching agent is sodium hypochlorite and the alkaline reagent is selected from the group consisting of sodium hydroxide and potassium hydroxide.

* * * * *